US008939733B2

(12) United States Patent
Mann et al.

(10) Patent No.: US 8,939,733 B2
(45) Date of Patent: Jan. 27, 2015

(54) HYDRAULIC FAN ASSEMBLY FOR AN ENGINE VENTILATION SYSTEM

(75) Inventors: Ryan Chiaki Mann, Newnan, GA (US); Kalpeshbhai G. Patel, Streamwood, IL (US); William N. O'Neill, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 637 days.

(21) Appl. No.: 13/166,260

(22) Filed: Jun. 22, 2011

(65) Prior Publication Data

US 2012/0328455 A1 Dec. 27, 2012

(51) Int. Cl.

| | |
|---|---|
| ***F04B 47/08*** | (2006.01) |
| ***F04B 17/00*** | (2006.01) |
| ***F04B 35/04*** | (2006.01) |
| ***F03B 3/12*** | (2006.01) |
| ***F03B 7/00*** | (2006.01) |
| ***F04D 29/38*** | (2006.01) |
| ***F01D 5/22*** | (2006.01) |
| ***F03D 11/00*** | (2006.01) |
| ***F01D 1/24*** | (2006.01) |
| ***F04D 13/12*** | (2006.01) |
| ***F04D 29/00*** | (2006.01) |
| ***F04D 29/18*** | (2006.01) |
| ***F04D 25/04*** | (2006.01) |
| ***F04D 29/08*** | (2006.01) |
| ***F04D 29/10*** | (2006.01) |
| *F01P 3/12* | (2006.01) |
| *F01P 5/04* | (2006.01) |

(52) U.S. Cl.

CPC ..... *F04D 25/04* (2013.01); *F04D 29/083* (2013.01); *F04D 29/102* (2013.01); *F01P 3/12* (2013.01); *F01P 5/04* (2013.01)

USPC ..... 417/375; 417/423.1; 416/179; 416/200 R; 415/171.1; 415/174.5; 415/204

(58) Field of Classification Search

CPC ..... F04B 47/08; F04D 29/162; F04D 5/002

USPC ..... 417/375, 423.1; 416/179, 200 A; 415/171.1, 174.5, 204

See application file for complete search history.

(56) References Cited

U.S. PATENT DOCUMENTS

| | | | | |
|---|---|---|---|---|
| 4,086,976 | A * | 5/1978 | Holm et al. | 180/68.1 |
| 4,114,714 | A | 9/1978 | Fachbach et al. | |
| 4,181,172 | A | 1/1980 | Longhouse | |
| 5,156,522 | A * | 10/1992 | Tessier | 415/58.2 |
| 5,662,462 | A * | 9/1997 | Paley et al. | 418/61.3 |
| 5,732,894 | A * | 3/1998 | Sheahan | 241/56 |
| 6,216,778 | B1 * | 4/2001 | Corwin et al. | 165/299 |
| 6,599,088 | B2 * | 7/2003 | Stagg | 415/173.6 |
| 7,537,072 | B2 * | 5/2009 | Sturmon et al. | 180/68.1 |
| 2009/0025997 | A1 * | 1/2009 | Ishii et al. | 180/242 |
| 2010/0186381 | A1 | 7/2010 | Charles et al. | |

* cited by examiner

*Primary Examiner* — Devon Kramer
*Assistant Examiner* — Lilya Pekarskaya
(74) *Attorney, Agent, or Firm* — Miller, Matthias & hull

(57) ABSTRACT

A fan for an engine ventilation system includes a housing defining an inlet and an outlet. A hydraulic motor is coupled to the fan housing and includes a motor housing, motor shaft, and shaft seal disposed between the motor housing and the motor shaft. An impeller assembly is disposed in the housing, as well as a stationary baffle that includes a baffle inner edge disposed axially between the impeller assembly and a second wall of the fan housing. A deflector disc is coupled to the impeller assembly and includes a deflector disc outer edge positioned axially rearward of the baffle inner edge. The deflector disc and baffle direct any hydraulic fluid leaking past the shaft seal away from the impeller assembly to a collection chamber.

12 Claims, 8 Drawing Sheets

210
100
164
104
206
212
204
114
170
168
166
202
138
162
120
178
150
156
180
176
154
217
213
218
219
215
214
216
152

HYDRAULIC FAN ASSEMBLY FOR AN ENGINE VENTILATION SYSTEM

TECHNICAL FIELD

The present disclosure generally relates to ventilation systems for engines, engine enclosures, and engine compartments, and more particularly to hydraulic powered fans used in such systems.

BACKGROUND

Aftertreatment systems are often utilized to reduce emissions associated with operation of engines. The State of California and the United States Environmental Protection Agency have imposed stricter emissions requirements over time, adopting increasingly stringent standards for criteria pollutants, such as $NO_x$, unburned hydrocarbons, carbon monoxide, sulfur dioxide, ozone, lead, and particulate matter. In addition to heat produced by engines themselves, aftertreatment systems incorporated in order to meet such requirements have contributed to excessive heat in the operation of such machines. Excessive heat associated with the engine or the aftertreatment systems may be further increased due to insulating structures designed to minimize noise transmitted to the surroundings, including the passenger compartment.

Various arrangements have been proposed for cooling the engine and related components. For example, U.S. Pat. No. 4,114,714 to Fachbach, et al. discloses a forced draft ventilation system that includes a first fan that pulls air through front grill and the radiator, and a second fan that receives air from an external inlet port directed forward the vehicle and forces the air across the engine, a portion of the heated air then being directed out of the engine compartment, and a portion of the heated air then being directed across the exhaust system and out of the vehicle. Inasmuch as the second fan is driven by the engine and is depicted as a relatively small device, and the inlet to the second fan is directed forward the vehicle, it would appear that second fan is dependent, at large in part, upon the forward movement of the vehicle to force fresh air to the second fan. Accordingly, the second fan may be unable to reduce adequately the engine compartment temperatures during idling situations, or when the machine travels in a direction such that the cab or other structure blocks ambient air flow into the engine compartment. Moreover, the air that is directed over the exhaust system has already been heated by moving over the engine itself, minimizing any resultant cooling of the exhaust components.

More recently, engine ventilation systems have been used to cool the enclosure or compartment that houses the engine and the aftertreatment systems. The engine ventilation systems may include one or more ventilation fans in addition to the engine radiator or air-to-air aftercooler fan. The engine compartment ventilation fan pressurizes the engine compartment and improves air flow through the compartment. Some machines, such as wheel loaders and hydraulic excavators, use hydraulic powered ventilation fans. Such fans are driven by a hydraulic motor having a shaft seal to prevent hydraulic fluid from leaking along the motor shaft. Should the motor shaft seal fail, hydraulic fluid may become entrained in the air flow stream exiting the ventilation fan and ultimately may be sprayed throughout the engine compartment. The operating temperatures of the aftertreatment components may be sufficiently high to ignite the hydraulic fluid, thereby presenting a potential fire hazard.

SUMMARY OF THE DISCLOSURE

According to certain aspects of this disclosure, a centrifugal fan is provided for use with a source of hydraulic fluid.

The fan may include a fan housing having a first side wall defining an inlet and a second side wall spaced from the first side wall, the fan housing further defining an outlet. A hydraulic motor is coupled to the second side wall of the fan housing and includes a motor housing, a hydraulic chamber disposed in the motor housing and fluidly communicating with the source of hydraulic fluid, a rotatable motor shaft extending along a shaft axis, the motor shaft having an axially rearward end hydraulically coupled to the hydraulic chamber and an axially forward end disposed in the fan housing, and a shaft seal disposed between the motor housing and the motor shaft. An impeller assembly is coupled to the axially forward end of the motor shaft, and a stationary baffle is disposed between the first and second side walls of the fan housing, the baffle including a baffle inner edge disposed axially between the impeller assembly and the second wall. A deflector disc is coupled to the impeller assembly and includes a deflector disc outer edge positioned axially rearward of the baffle inner edge.

In another aspect of the disclosure that may be combined with any of these aspects, the fan housing may define an interior chamber and the baffle may divide the interior chamber into an impeller chamber in which the impeller assembly is disposed and a collection chamber in which the deflector disc outer edge is disposed.

In another aspect of the disclosure that may be combined with any of these aspects, the second side wall of the fan housing may be configured to define a reservoir in a lower portion of the collection chamber.

In another aspect of the disclosure that may be combined with any of these aspects, the impeller assembly may comprise an impeller plate and a plurality of impeller blades coupled to the impeller plate, each impeller blade having a radial outer periphery relative to the shaft axis, and the baffle inner edge is disposed radially inwardly of the radial outer periphery of each impeller blade.

In another aspect of the disclosure that may be combined with any of these aspects, the impeller assembly may comprise a hub, and the deflector disc may be coupled to the hub.

In another aspect of the disclosure that may be combined with any of these aspects, the deflector disc may include a planar deflector disc central portion coupled to the impeller assembly and a non-planar deflector disc outer portion defining the deflector disc outer edge.

In another aspect of the disclosure that may be combined with any of these aspects, the deflector disc outer portion may extend axially rearward from the deflector disc central portion.

In another aspect of the disclosure that may be combined with any of these aspects, the baffle may include a planar baffle outer portion coupled to the fan housing and a non-planar baffle inner portion defining the baffle inner edge.

In another aspect of the disclosure that may be combined with any of these aspects, the baffle inner portion may extend axially forward from the baffle outer portion.

In another aspect of the disclosure that may be combined with any of these aspects, a centrifugal fan is provided for use with a source of hydraulic fluid. The fan may include a fan housing defining an interior chamber, the fan housing including a first side wall defining an inlet and a second side wall spaced from the first side wall, the fan housing further defining an outlet. A stationary baffle may be coupled to the fan housing and disposed between the first and second side walls to separate the interior chamber into an impeller chamber adjacent the first side wall and a collection chamber adjacent the second side wall, the baffle including a baffle inner edge. A hydraulic motor may be coupled to the second side wall of the fan housing. The hydraulic motor may include a motor housing, a hydraulic chamber disposed in the motor housing and fluidly communicating with the source of hydraulic fluid, a rotatable motor shaft extending along a shaft axis, the motor shaft having a first end hydraulically coupled to the hydraulic chamber and a second end disposed in the impeller chamber, an outer surface of the motor shaft defining a shaft flow path for hydraulic fluid extending substantially parallel to the shaft axis, and a shaft seal disposed between the motor housing and the motor shaft and in the shaft flow path. An impeller assembly may be coupled to second end of the motor shaft and define an impeller assembly leak flow path for hydraulic fluid extending substantially perpendicular to the shaft axis from the shaft flow path to a periphery of the impeller assembly. A deflector disc may be coupled to the impeller assembly and include a deflector disc outer edge oriented toward the collection chamber and a deflector disc rear surface defining a deflector flow path for hydraulic fluid extending from an intermediate portion of the impeller assembly leak flow path, thereby to divert leaking hydraulic fluid toward the collection chamber.

In another aspect of the disclosure that may be combined with any of these aspects, a centrifugal fan is provided for use with a source of hydraulic fluid that may include a hydraulic motor having a motor housing, a hydraulic chamber disposed in the motor housing and fluidly communicating with the source of hydraulic fluid, a rotatable motor shaft extending along a shaft axis, the motor shaft having an axially rearward end hydraulically coupled to the hydraulic chamber and an axially forward end disposed in the fan housing, and a shaft seal disposed between the motor housing and the motor shaft. An impeller assembly may be coupled to the axially forward end of the motor shaft. A deflector disc may be coupled to the impeller assembly and may include a deflector disc outer edge positioned axially rearward of the baffle inner edge.

In another aspect of the disclosure that may be combined with any of these aspects, the impeller assembly may comprise an impeller plate and a plurality of impeller blades coupled to the impeller plate, each impeller blade having a radial outer periphery relative to the shaft axis, and the deflector plate outer edge is disposed radially inwardly of the radial outer periphery of each impeller blade.

DETAILED DESCRIPTION

Embodiments of a ventilation fan are disclosed for use in a ventilation system provided for an engine compartment. The engine compartment may house the engine and one or more aftertreatment systems. For some machines, such as wheel loaders and hydraulic excavators, the ventilation fan is operated using hydraulic power. The ventilation fan includes a stationary baffle and a rotating deflector disc to prevent hydraulic fluid from becoming entrained in the air stream exiting the ventilation fan. More specifically, the ventilation fan includes a housing defining an interior chamber. The stationary baffle divides the interior chamber into an impeller chamber and a collection chamber. The deflector disc is configured to divert fluid from its normal leak path by directing the fluid away from the impeller chamber and toward the collection chamber. The collection chamber may include a reservoir in which diverted fluid collects. A drain conduit fluidly communicates with the reservoir to allow the fluid to be discharged from the reservoir. The drain conduit may include a clear conduit section or drain reservoir that provides a visual indication to the user that fluid is leaking from the hydraulic fan.

Figure 1:
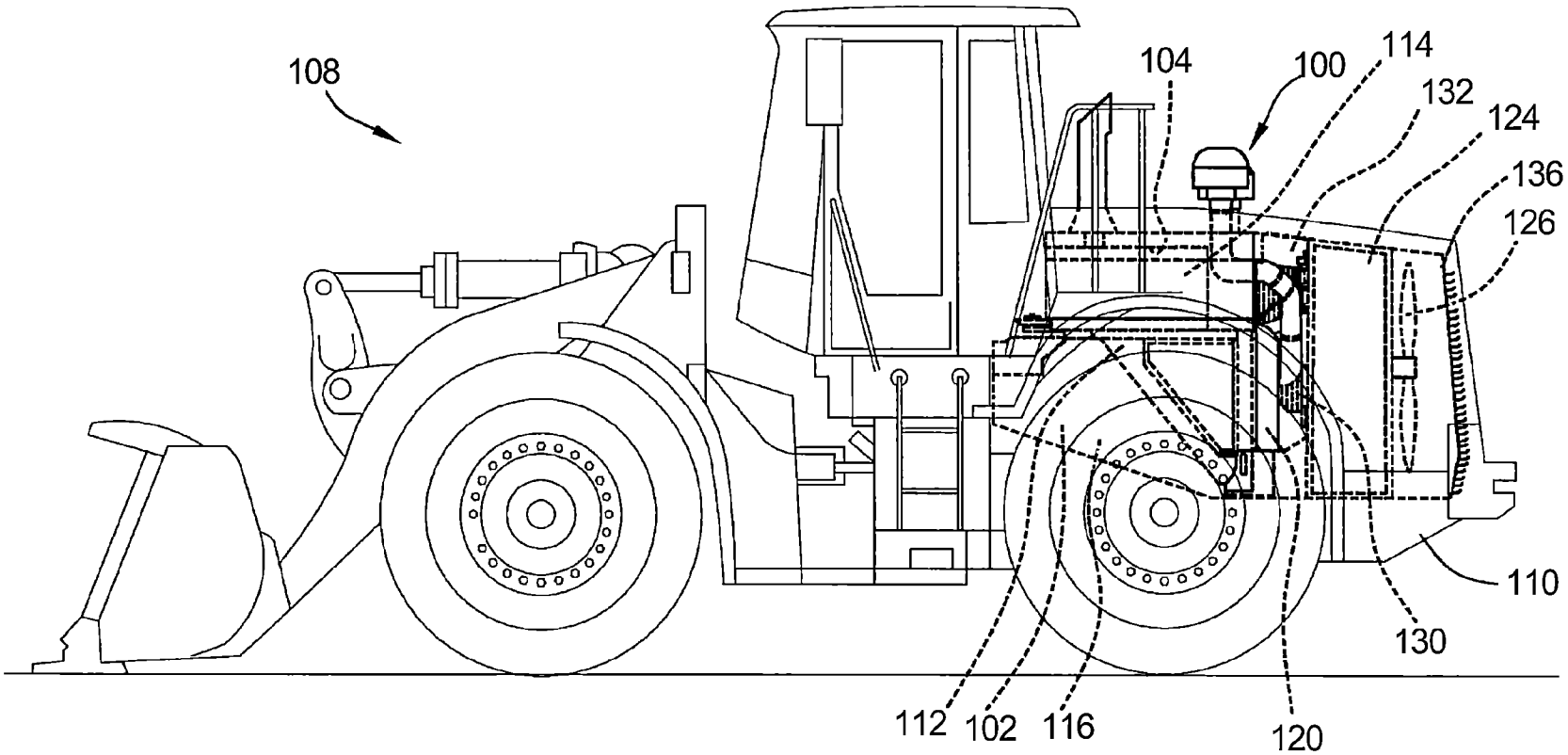
FIG. 1 is a schematic side elevational view of a wheel loader including an exemplary hydraulic fan assembly.

Turning to the illustrated embodiments, FIG. 1 shows a ventilation system 100 for an engine compartment 102 of a machine, such as a wheel loader 108. While the ventilation system 100 is illustrated in connection with a wheel loader 108, the ventilation system 100 disclosed herein has universal applicability in various other types of machines. The term "machine" may refer to any machine that performs some type of operation associated with an industry such as mining, construction, farming, transportation, or any other industry known in the art. For example, the machine may be a wheel loader 108, an excavator, a motor grader, a landfill or other type of compactor, or a wheel dozer. Moreover, one or more implements may be connected to the machine. Such implements may be utilized for a variety of tasks, including, for example, brushing, compacting, grading, lifting, loading, plowing, ripping, and include, for example, augers, blades, breakers/hammers, brushes, buckets, compactors, cutters, forked lifting devices, grader bits and end bits, grapples, blades, rippers, scarifiers, shears, snow plows, snow wings, and others.

Figure 2:
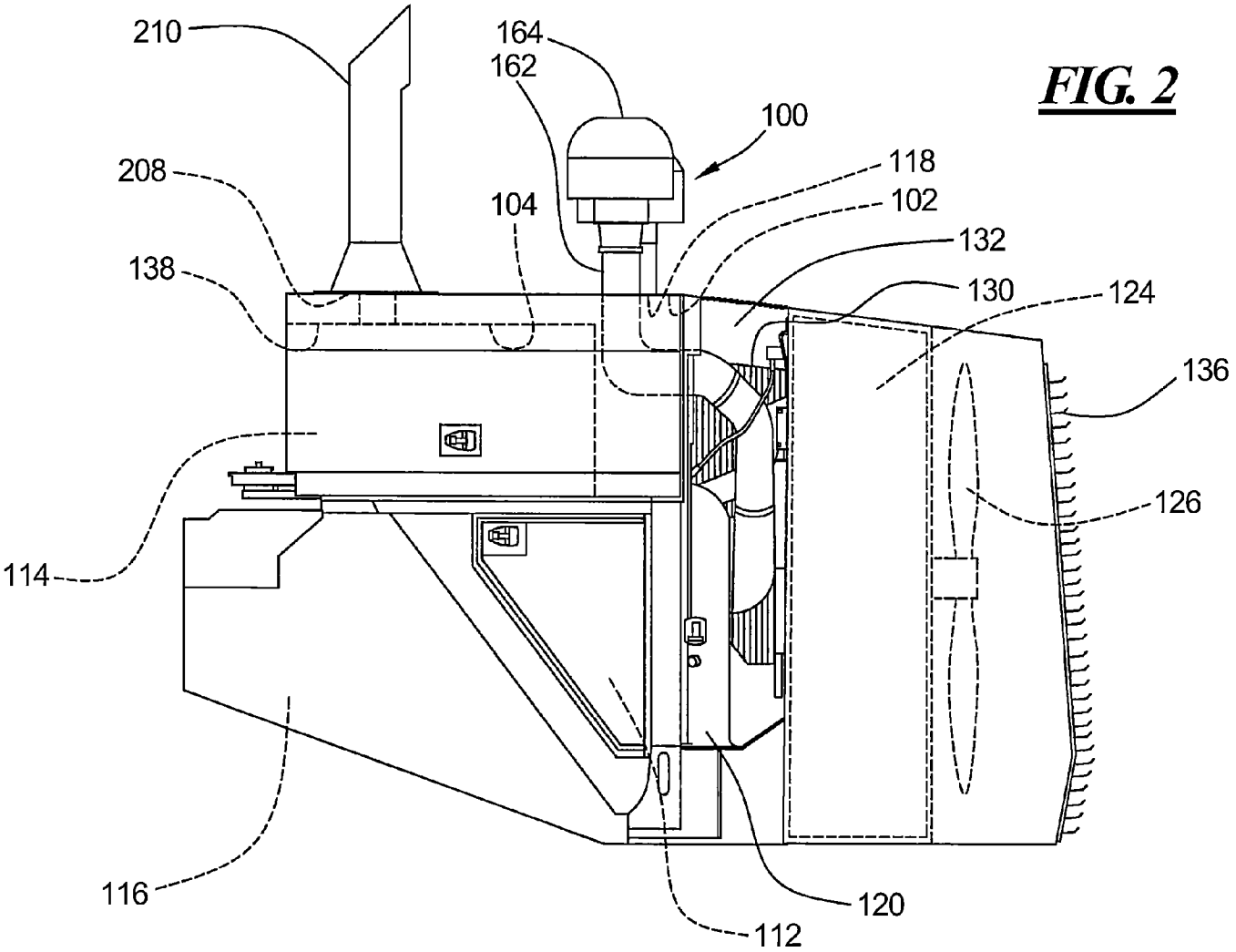
FIG. 2 is an enlarged fragmentary side view of an engine compartment, a secondary compartment, and the exemplary fan assembly utilized in the wheel loader of FIG. 1.

The illustrated wheel loader 108 includes a body 110 that includes the engine compartment 102. The engine compartment 102 houses an engine 112 and aftertreatment equipment 114 which receives exhaust from engine 112 (each of these items being shown generally in FIGS. 1 and 2). The wheel loader 108 additionally includes a hydraulic system 116 that may include a plurality of components such as pumps, valves, and conduits, along with a hydraulic fluid reservoir (components not shown in detail). The hydraulic system 116, as well as other systems in the machine, may include its own cooling arrangement.

The engine compartment 102 defines an interior 118 that at least partially encloses the components of the engine 112, and may include one or more walls that are formed by, for example, interior surfaces of the body 110. In the illustrated embodiment, a soundwall 120 forms a portion of the engine compartment 102. In an embodiment, the engine compartment 102 is substantially closed, although some gaps exist that allow passage of air from inside of the engine compartment 102 to outside of the engine compartment.

The wheel loader 108 may include a radiator 124 for cooling engine fluid, as well a radiator fan 126 disposed to cause movement of air across the radiator 124 to cool engine fluid. While the radiator fan 126 may be disposed to either draw or push the cooling air across the radiator 124, in the illustrated embodiment, the radiator fan 126 is disposed to draw air through vents 130 in the sides 132 of the machine into the area surrounding the radiator 124, the radiator fan 126 drawing the air across the radiator 124 and out the back wall 136 of the machine.

The aftertreatment equipment 114 may include aftertreatment systems for reducing emissions, such as $NO_x$, unburned hydrocarbons, carbon monoxide, sulfur dioxide, ozone, lead, and particulate matter, contained in exhaust received from the engine 112 during operation. Such aftertreatment systems may include, for example, selective catalytic reduction (SCR), diesel oxidation catalysts (DOC), and diesel particulate filters (DPF), which are known in the art. One or more of these aftertreatment systems may be at least partially disposed within an interior 138 of an aftertreatment housing 104. The aftertreatment housing 104 may be contained substantially within the engine compartment 102, as shown, or it may be separate from the engine compartment 102. The aftertreatment equipment 114 may further include one or more sensors 142 and electrical components 144 (see, e.g., FIG. 4), which may be disposed within the aftertreatment housing 104 or, for example, along the exterior of the aftertreatment housing 104. The aftertreatment housing 104 may be formed of any suitable material, and may include insulating material. In the illustrated embodiment, the aftertreatment housing 104 is contained within the engine compartment 102, although, alternatively, the aftertreatment housing 104 may form a wall of the engine compartment 102.

The wheel loader 108 further includes a ventilation system 100 that includes a ventilation fan 150, the output of which supplies cooling air to one or more of the components contained within the engine compartment 102, the aftertreatment housing 104, and/or to the sensors 142. In the illustrated embodiment, a centrifugal ventilation fan 150 is utilized, although the ventilation fan 150 may be of any appropriate design and utilize any appropriate power source. Although the ventilation fan 150 may be electronically operated, battery powered, or directly coupled to the engine 112, an embodiment is hydraulically driven by a motor 152 (see FIG. 3) coupled to the hydraulic system 116. In this way, the output of the ventilation fan 150 is not directly affected by the output of the engine 112, allowing the ventilation fan 150 to operate at a desired speed, independent of the speed of the engine 112.

The ventilation fan 150 of the illustrated embodiment is a centrifugal fan. While the ventilation fan 150 may be disposed in any appropriate location, in the illustrated embodiment, the ventilation fan 150 is coupled to the soundwall 120. A fan housing 154 is formed by a volute 156 and a portion of the soundwall 120, as may be seen in FIGS. 3-5. A plurality of fasteners, such as bolts 158, may secure the volute 156 to the soundwall 120. The soundwall 120 and volute 156 may be of any appropriate material, such as, for example, an unsaturated polyester with glass mat reinforcement, or fiberglass.

Returning to FIGS. 3 and 4, air is supplied to the ventilation fan 150 through an inlet air conduit 162 that extends from the fan housing 154 to the exteriors of the aftertreatment housing 104 and the engine compartment 102. In order to minimize debris entering the ventilation fan 150, the ventilation system 100 may further include a precleaner 164 disposed at an inlet 166 to the inlet air conduit 162. In this way, air enters an inlet 168 to the precleaner 164 and flows from an outlet 170 of the precleaner 164 to the inlet 166 to the inlet air conduit 162. Air then flows through the inlet air conduit 162 and from an outlet 172 of the inlet air conduit 162 to an inlet 174 to the ventilation fan housing 154.

The precleaner 164 may be of any custom or conventional design. The precleaner 164 may include, for example, an internally mounted impeller (not shown) that throws dirt and debris to the periphery of the precleaner 164 such that air passing through the precleaner 164 to the outlet 170 contains less dirt and/or debris than air entering the inlet 168 to the precleaner 164. In this way, having the inlet 168 to the precleaner 164—and ultimately, the inlet 174 to the ventilation fan housing 154—open to the exterior of the engine compartment 102, circulates cooling air that contains reduced dirt and/or debris. This effect may be enhanced by placement of the inlet 168 to the precleaner 164 at a location distal from structures and environments that would provide warmer and/or dirtier air, such as, for example, areas near machine wheels or a road.

According to the ventilation system 100, cooling air from an outlet 176 of the ventilation fan 150 is provided to at least one of the components of the engine compartment 102 or the aftertreatment housing 104, or to the sensor 142. In the illustrated embodiment, a duct 178 directs cooling air to each of the interiors 118, 138 of the engine compartment 102 and the aftertreatment housing 104, as well as to the aftertreatment sensor 142 disposed along the exterior of the aftertreatment housing 104.

Figure 3:
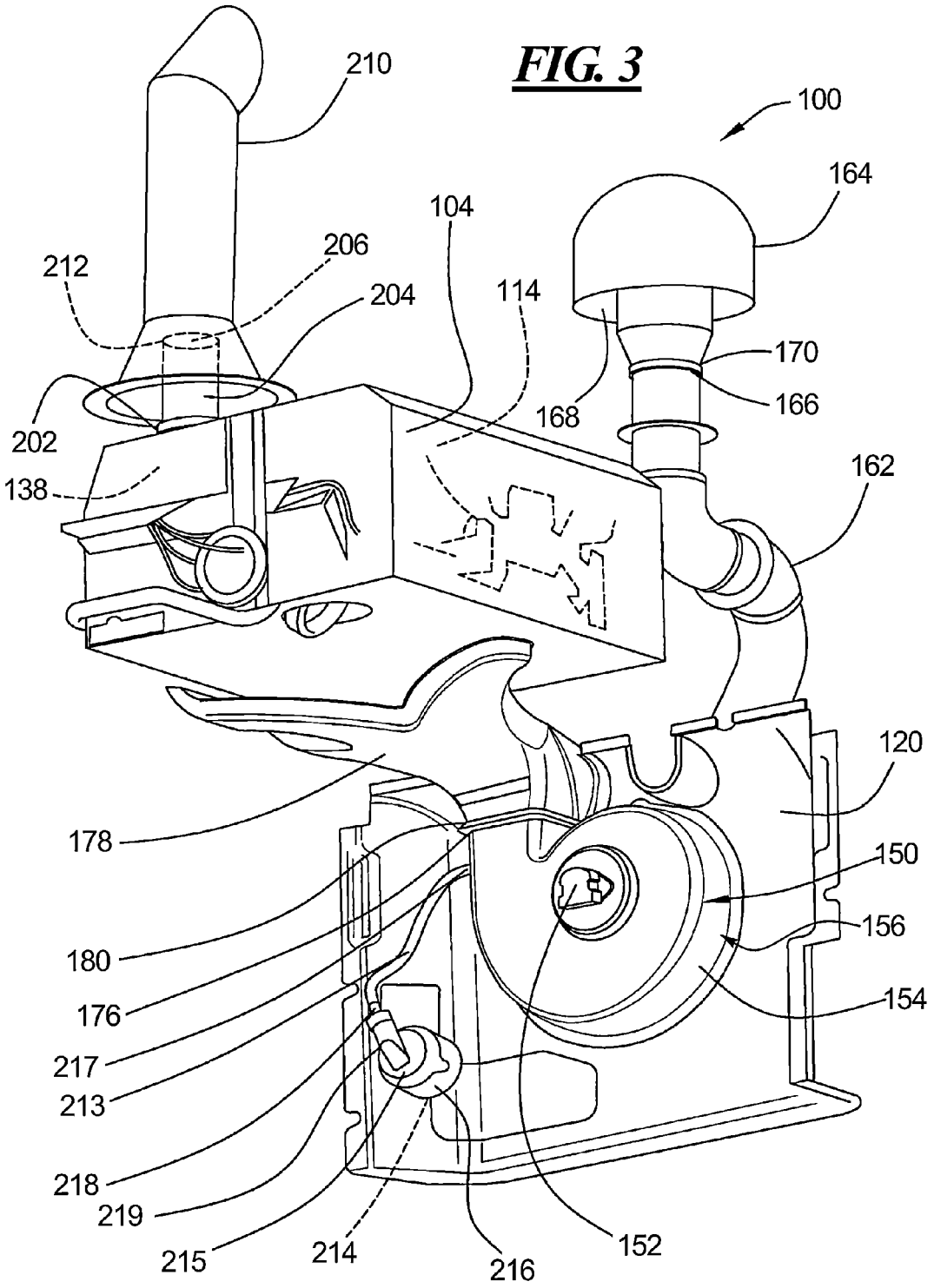
FIG. 3 is a fragmentary isometric view of the secondary compartment, the sound wall, and the ventilation system of FIG. 2, the engine compartment being cut away.
Figure 4:
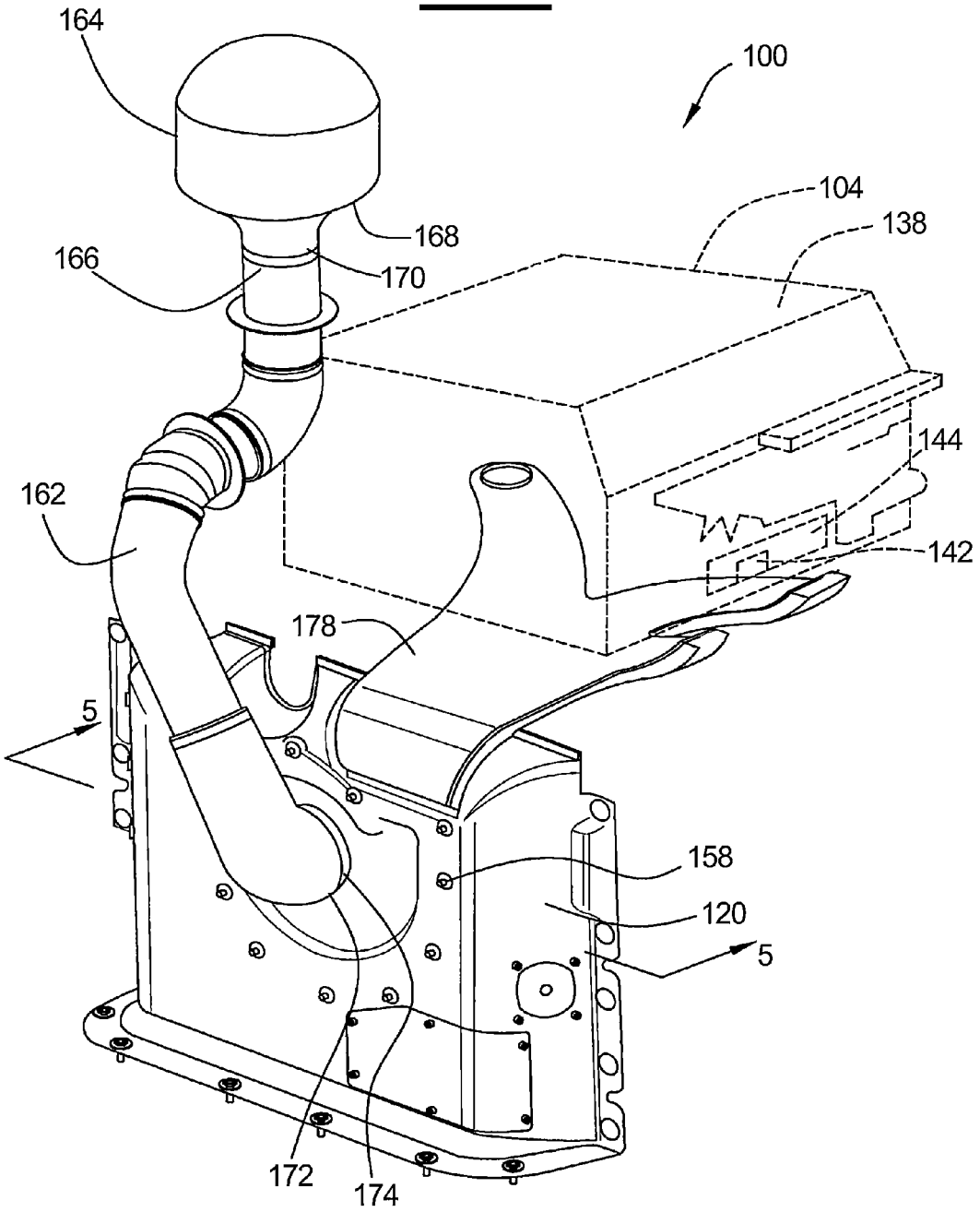
FIG. 4 is a fragmentary isometric view of the sound wall and ventilation system of FIGS. 2 and 3, the secondary compartment being shown in phantom.

As may be seen in FIGS. 3 and 4, the duct 178 includes an inlet 180 that is fluidly coupled to the outlet 176 of the ventilation fan 150. The duct 178 includes passageways that direct cooling air to various outlets positioned to direct cooling air into the engine compartment 102, the aftertreatment housing 104, the electrical components 144, and sensors 142 that control the operation of the aftertreatment systems. While the duct 178 has been described as a single duct, it may also be considered a plurality of ducts directed to various components of the machine. Those of skill will appreciate that the ducting structure could alternately include a plurality of single ducts in fluid communication with a single outlet or respective outlets of the ventilation fan 150.

As shown in FIG. 3, an air hose or duct 213 may be provided to supply cooling air to individual engine components where individualized cooling may be desirable. For example, a duct 213 may be provided to the alternator 214, here through the alternator cover 215 into the alternator housing 216. An inlet 217 to the duct 213 is coupled to the ventilation fan housing 154 to provide fluid communication with the ventilation fan 150, while the outlet 218 of the duct 213 opens to an inlet 219 to the alternator cover 215. In this way, the ventilation fan 150 pushes cooling air into the alternator housing 216 to directly cool the alternator 214.

Returning to the cooling of the aftertreatment equipment 114, as the ventilation fan 150 pushes air into the aftertreatment housing 104 to cool the aftertreatment equipment 114 contained therein, air, now heated by the equipment 114, is expelled from the aftertreatment housing 104 through an aftertreatment housing outlet 202 (FIG. 3). In order to carry the heated air away from the machine, the aftertreatment housing outlet 202 connects to an elongated stack 204, which is disposed at a top portion of the aftertreatment housing 104 in an embodiment. An outlet 206 of the elongated stack 204 exhausts heated air from the aftertreatment housing 104 a distance from the inlet 168 to the precleaner 164.

Inasmuch as the engine compartment 102 is substantially closed, the direct flow of cooling air from the duct outlet into the engine compartment 102 may act to pressurize the engine compartment 102. Accordingly, this pressurization of the engine compartment 102 not only inhibits the passage of dirt or debris that may otherwise pass into the engine compartment 102 through any gaps in the walls defining the engine compartment 102, the pressure differential between the engine compartment 102 and the surrounding atmosphere may also cause the expulsion of such dirt and debris that may be disposed within the engine compartment 102.

In order to allow the escape of heated air from the engine compartment 102, an engine compartment outlet 208 (FIG. 2) is provided. In the illustrated embodiment, the engine compartment outlet 208 is provided near the upper portion of the engine compartment 102 to allow the rising heated air to escape. An elongated stack 210 is fluidly coupled to the outlet 208 of the engine compartment 102, allowing the heated air to rise up out of the engine compartment 102 and be exhausted at a distance from the inlet 168 to the precleaner 164.

According to an embodiment, the engine compartment outlet 208 and the elongated stack 210 of the engine compartment circumferentially surrounds the elongated stack 204 associated with the aftertreatment housing outlet 202. As may be seen in FIG. 3, in an embodiment, the outlet 206 of the aftertreatment housing elongated stack 204 extends only a portion of the height of the elongated stack 210 of the engine compartment 102. Accordingly, the nesting of these stacks 204, 210 acts as a venturi such that the heated air entering the elongated stack 204 from the aftertreatment housing 104 exits the outlet 206 at a distal end 212 of the stack 204 at a relatively high speed, creating an area of low pressure around the periphery of the distal end 212. As a result, the high speed, heated air leaving the aftertreatment housing stack 204 pulls with it the heated air within the engine compartment stack 210, carrying the heated air away from the machine.

Figure 6:
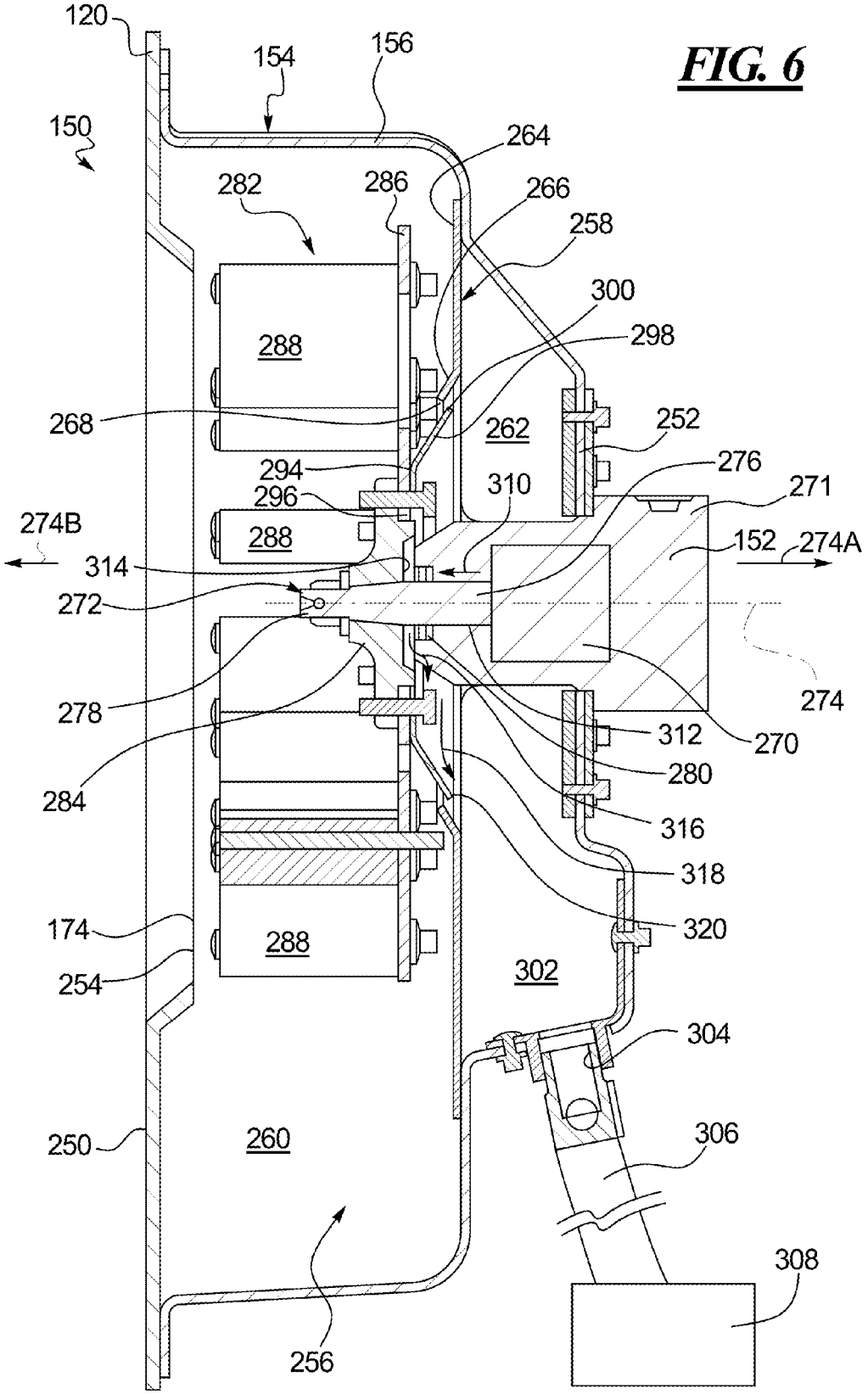
FIG. 6 is a fragmentary side elevational view of the hydraulic fan assembly.

Returning to the ventilation fan 150, as noted above the fan housing 154 is formed by the volute 156 and a portion of the soundwall 120. As best shown in FIG. 6, the portion of the soundwall 120 provides a first housing side wall 250 while the volute 156 provides a second housing side wall 252 spaced from the first housing side wall 250. The first housing side wall 250 has an aperture 254 defining the fan inlet 174. The fan 150 also includes the fan outlet 176. The fan housing 154 further defines an interior chamber 256 for receiving fan components, as described in greater detail below.

Figure 5:
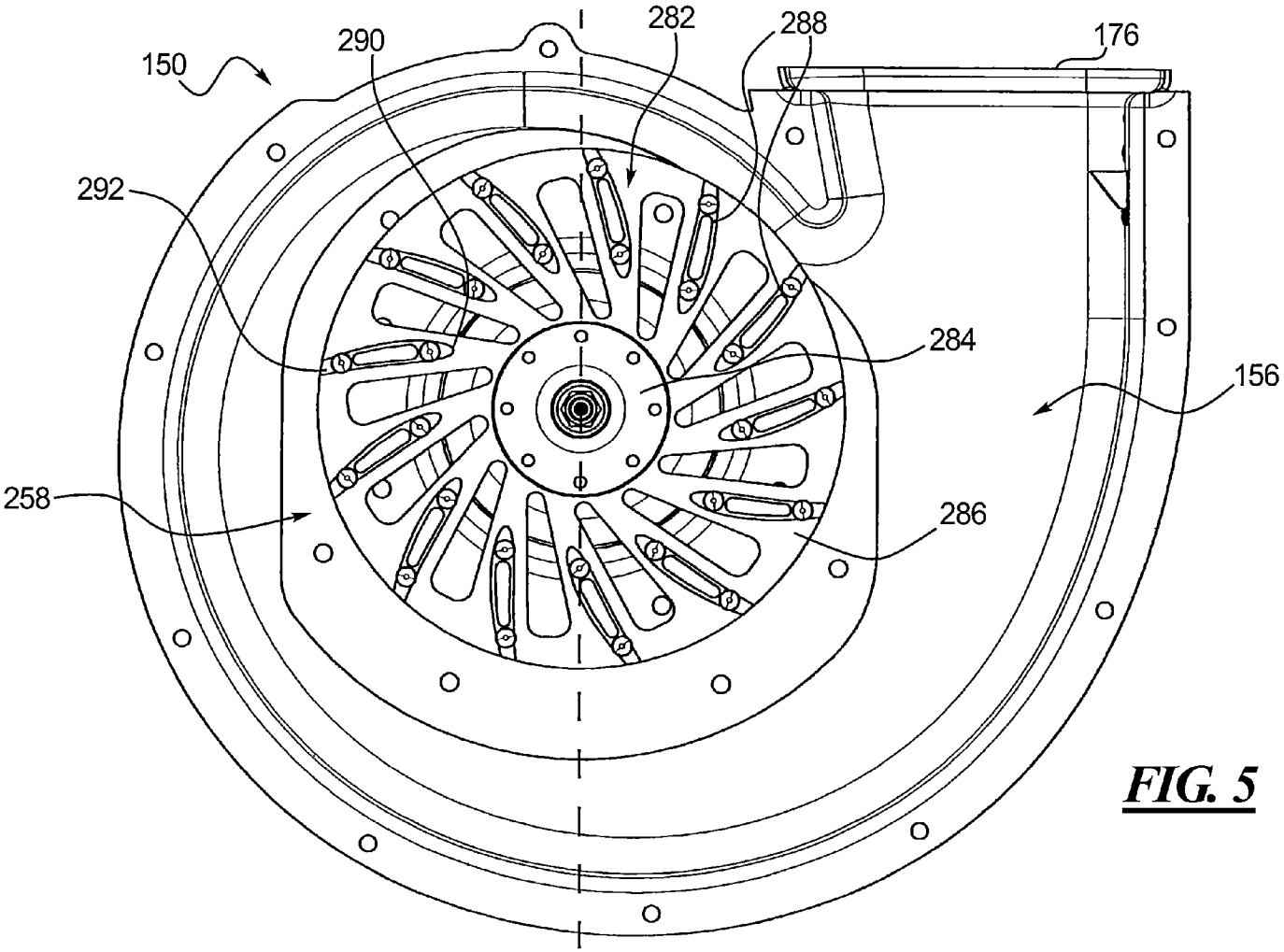
FIG. 5 is a fragmentary rear elevational view of the hydraulic fan assembly.
Figure 7B:
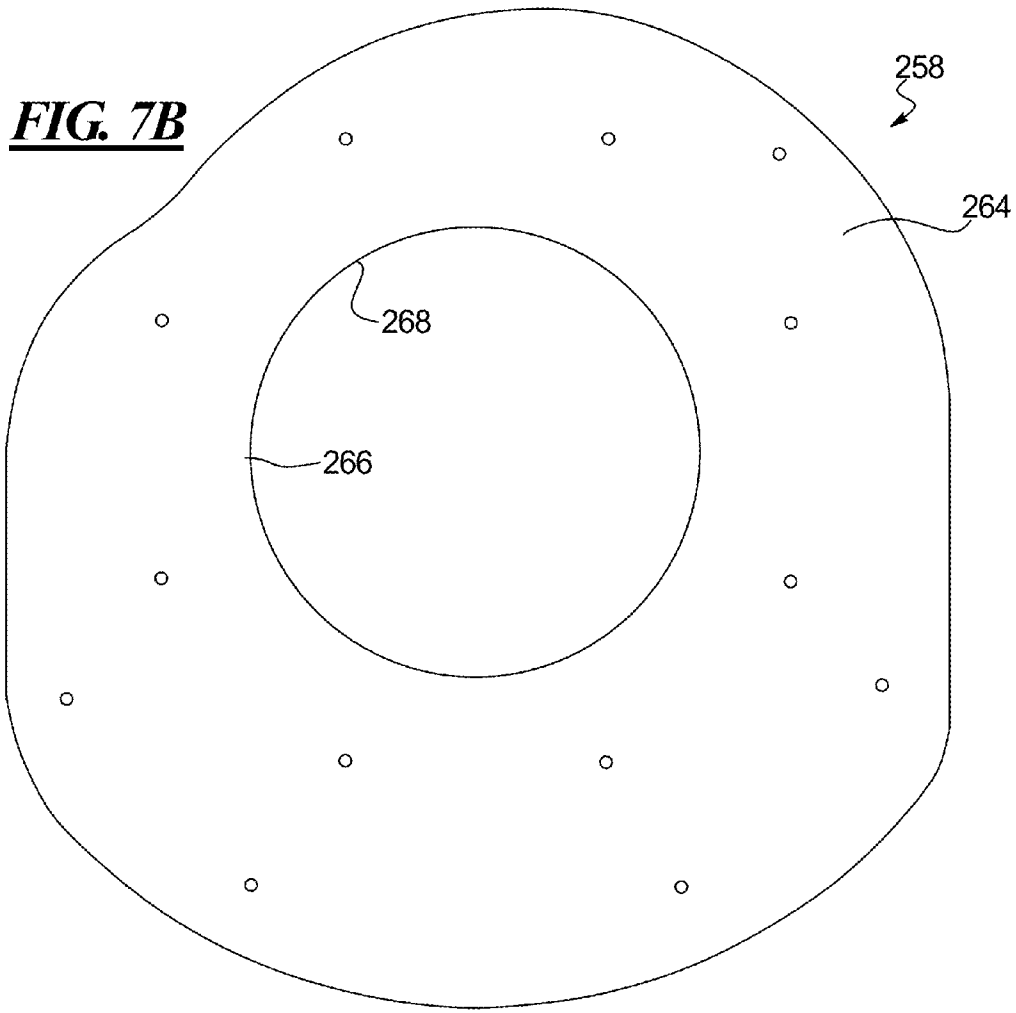
FIG. 7B is a front view of the baffle of FIG. 7A.
Figure 7A:
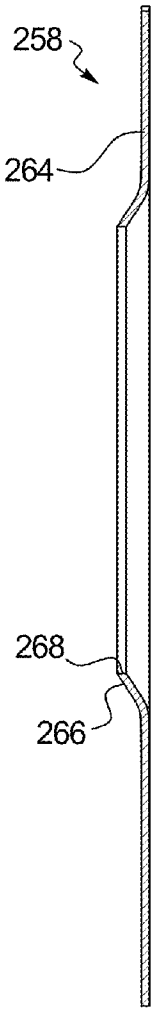
FIG. 7A is a side elevation view, in cross-section, of a baffle used in the hydraulic fan assembly.

A stationary baffle 258 is provided inside the fan housing 154 that divides the interior chamber 256 into an impeller chamber 260 and a collection chamber 262. As best shown in FIGS. 5 and 6, the baffle 258 is disposed between the first and second side walls 250, 252 of the fan housing 154. The baffle 258 includes a substantially planar baffle outer portion 264 and a non-planar baffle inner portion 266 (FIGS. 7A and 7B). The baffle inner portion 266 defines a baffle inner edge 268 that extends toward the first side wall 250 of the fan housing 154.

As best illustrated in FIG. 6, the fan motor 152 may be coupled to the second side wall 252 of the fan housing 154. The motor 152 may be hydraulically powered, and therefore may include a hydraulic chamber 270 disposed in a motor housing 271 and fluidly communicating with a source of hydraulic fluid, such as the hydraulic system 116. The motor 152 may further include a rotatable motor shaft 272 extending along a shaft axis 274 that defines an axially rearward direction 274A and an axially forward direction 274B. As used herein, the terms "forward" and "rearward" are used to define directions relative to the motor shaft 272, which may or may not be the same convention used to identify directions relative to the overall machine or the direction of machine travel. The motor shaft 272 has a first or axially rearward end 276 hydraulically coupled to the hydraulic chamber 270 and a second or axially forward end 278 extending into the impeller chamber 260. A shaft seal 280 is provided between the motor shaft 272 and the motor housing 271 to prevent hydraulic fluid from leaking along the shaft.

The fan 150 also includes an impeller assembly 282 coupled to the motor shaft 272 and disposed in the impeller chamber 260 for drawing air into the fan inlet 174 and creating a ventilation air stream exiting the outlet 176. As best shown in FIGS. 5 and 6, the impeller assembly 282 includes a hub 284 attached directly to the motor shaft 272. An impeller plate 286 is attached to the hub 284. A plurality of impeller blades 288 are mounted on the impeller plate 286 and oriented to create a centrifugal air stream through the fan outlet 176. Each impeller blade 288 includes an inner periphery 290 disposed proximally relative to the shaft axis 274 and an outer periphery 292 disposed distally relative to the shaft axis 274. In the illustrated embodiment, the baffle inner edge 268 is disposed radially inwardly of the radial outer periphery 292 of each impeller blade 288.

Figure 8B:
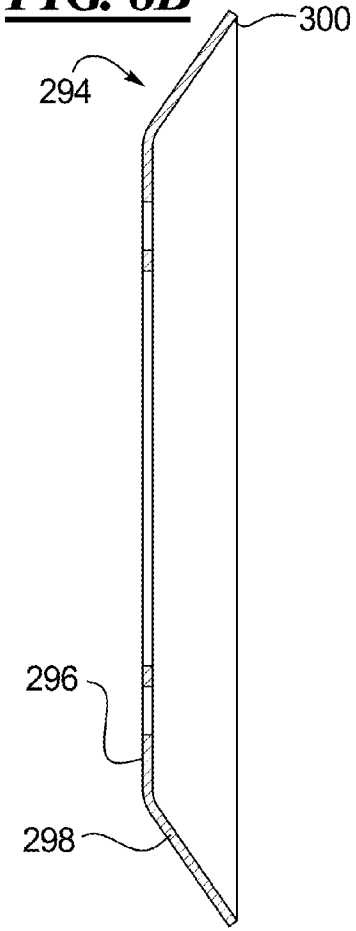
FIG. 8B is a side elevation view, in cross-section, of the deflector disc of FIG. 8A.
Figure 8A:
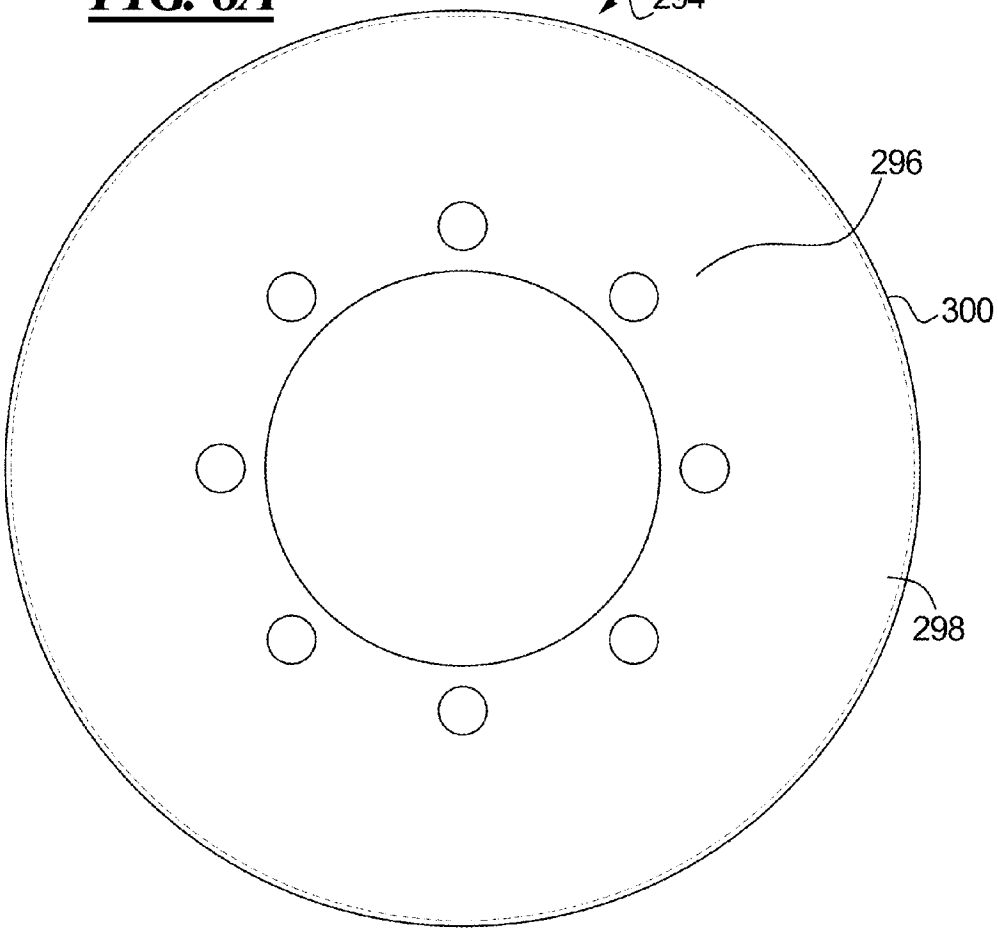
FIG. 8A is a front view of a deflector disc used in the hydraulic fan assembly.

The fan 150 further includes a deflector disc 294. Should the shaft seal 280 fail, thereby leaking hydraulic fluid along the motor shaft 272, the deflector disc 294 prevents fluid from reaching the fan airstream by directing the fluid toward the collection chamber 262 and away from the impeller chamber 260. In the exemplary embodiment best shown in FIG. 6, the deflector disc 294 includes a substantially planar deflector disc central portion 296 coupled to the impeller plate 286 and a non-planar deflector disc outer portion 298 defining a deflector disc outer edge 300 (FIGS. 8A and 8B). In the illustrated embodiment, the deflector disc outer portion 298 extends axially rearward from the deflector disc central portion 296, toward the second side wall 252 of the fan housing 154. The outer edge 300 of the deflector disc 294 is positioned axially rearward of the inner edge 268 of the baffle 258 to ensure that any leaking hydraulic fluid is directed away from the impeller chamber 260 and toward the collection chamber 262.

A drain assembly may be provided for discharging hydraulic fluid from the collection chamber 262 and for providing an indication that the shaft seal 280 has failed. As best shown in FIG. 6, the drain assembly may include a reservoir 302 formed at a bottom of the collection chamber 262. The reservoir 302 is positioned so that hydraulic fluid directed to the collection chamber 262 will ultimately flow under gravity to the reservoir 302. The reservoir 302 includes an outlet 304 fluidly communicating with a drain conduit 306. The drain conduit 306 may discharge to the environment or may be coupled to a discharge chamber or reservoir (not shown) for periodic pre-operation inspection or maintenance. The drain conduit 306 may be formed of a translucent or transparent material to permit a user to observe fluid flow, thereby providing a visual indication that the shaft seal 280 has failed. Additionally or alternatively, a translucent or transparent drain tank 308 may be provided in the drain conduit 306 that allows a predetermined volume of hydraulic fluid to collect, thereby providing a more readily observable indication that the shaft seal 280 has failed.

It will be appreciated that certain components of the ventilation fan 150 may form a fan sub-assembly that may be removed and replaced, if needed. For example, the fan motor 152, impeller assembly 282, and deflector disc 294 may be removed and replaced as a unitary sub-assembly in the event the shaft seal 280 fails.

INDUSTRIAL APPLICABILITY

The present disclosure is applicable to machines that include a hydraulically powered ventilation fan 150 to cool engine 112 and/or aftertreatment equipment 114 or systems. The cooling airflow may be provided to an engine compartment 102 and/or aftertreatment housing 104 and related components to assist in controlled cooling of the compartments and components. The use of a hydraulic motor 152 to power the fan 150 introduces the possibility that hydraulic fluid may leak past the shaft seal 280 and become entrained in the ventilation air flow created by the fan 150. The baffle 258 and deflector disc 294 direct any such leaking fluid away from the impeller assembly 282, thereby reducing the likelihood of hydraulic fluid entering the ventilation air flow.

More specifically, the shaft seal 280 of the fan 150 may fail, thereby permitting hydraulic fluid to escape from the hydraulic chamber 270. A leak path for the hydraulic fluid begins with a shaft flow path 310 extending along an outer surface 312 of the motor shaft 272. The orientation of the shaft flow path 310 depends on the shape of the outer surface 312, which in the illustrated embodiment is substantially parallel to the shaft axis 274.

As the hydraulic fluid travels axially forward along the motor shaft 272, it will ultimately reach the impeller assembly 282. Specifically, the hub 284 of the impeller assembly 282 may be press fit onto the motor shaft 272, so that the hydraulic fluid is diverted from traveling further along the outer surface 312 of the motor shaft 272. A rear face 314 of the impeller assembly 282, namely rear surfaces the hub 284 and impeller plate 286, define an impeller assembly leak flow path 316 that extends substantially perpendicular or radially relative to the shaft axis 274 from the motor shaft 272 to an outer edge of the impeller plate 286.

A rear surface 320 of the deflector disc 294 defines a deflector flow path 318 for directing leaking hydraulic fluid from the impeller assembly leak flow path 316 to the collection chamber 262. The deflector disc 294 has an inner periphery coupled to an intermediate portion of the impeller plate 286 located between the inner and outer peripheries of the impeller plate 286. Accordingly, the deflector flow path 318 extends from the intermediate portion of the impeller plate 286 thereby to divert leaking fluid toward the collection chamber 262. The deflector flow path 318 may include a first portion that is oriented substantially perpendicular to (or radially from) the shaft axis 274, and a second portion that is angled axially rearward toward the collection chamber 262.

In operation, the impeller assembly 282 and deflector disc 294 rotate with the motor shaft 272. Hydraulic fluid leaking past the shaft seal 280 will first travel axially forward along the shaft flow path 310 until it reaches the impeller assembly 282. The fluid will then be diverted to flow generally radially along the impeller assembly leak flow path 316 until it reaches the deflector disc 294. The hydraulic fluid next travels along the deflector flow path 318 until it reaches the outer edge 300. Centrifugal force will discharge the hydraulic fluid from the outer edge 300 in a substantially radial direction. The inner edge 268 of the baffle 258 is positioned to receive the fluid ejected from the deflector plate, thereby retaining the fluid in the collection chamber 262. As noted above, hydraulic fluid in the collection chamber 262 will flow to the reservoir 302 under the force of gravity, where it may be discharged through the drain assembly.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A centrifugal fan for use with a source of hydraulic fluid, the fan comprising:

a fan housing including a first side wall defining an inlet and a second side wall spaced from the first side wall, the fan housing further defining an outlet;

a hydraulic motor coupled to the second side wall of the fan housing, the hydraulic motor including:

a motor housing;

a hydraulic chamber disposed in the motor housing and fluidly communicating with the source of hydraulic fluid;

a rotatable motor shaft extending along a shaft axis, the motor shaft having an axially rearward end hydraulically coupled to the hydraulic chamber and an axially forward end disposed in the fan housing;

a shaft seal disposed between the motor housing and the motor shaft;

an impeller assembly coupled to the axially forward end of the motor shaft;

a baffle which is stationary disposed between the first and second side walls of the fan housing, the baffle including a planar baffle outer portion and a non-planar baffle inner portion defining a baffle inner edge disposed axially between the impeller assembly and the second wall, the baffle inner portion extending toward the first wall of the fan housing; and a deflector disc coupled to and rotating with the impeller assembly, the deflector disc including a planar deflector disc inner portion, and a non-planar deflector disc outer portion extending toward the second wall of the fan housing and defining a deflector disc outer edge positioned axially rearward of the baffle inner edge.

2. The fan of claim 1, in which the fan housing defines an interior chamber, and in which the baffle divides the interior chamber into an impeller chamber in which the impeller assembly is disposed and a collection chamber in which the deflector disc outer edge is disposed.

3. The fan of claim 2, in which the second side wall of the fan housing defines a reservoir in a lower portion of the collection chamber.

4. The fan of claim 1, in which the impeller assembly comprises an impeller plate and a plurality of impeller blades coupled to the impeller plate, each impeller blade having a radial outer periphery relative to the shaft axis, and the baffle inner edge is disposed radially inwardly of the radial outer periphery of each impeller blade.

5. The fan of claim 1, in which the impeller assembly comprises a hub, and in which the deflector disc is coupled to the hub.

6. A centrifugal fan for use with a source of hydraulic fluid, the fan comprising:

a fan housing defining an interior chamber, the fan housing including a first side wall defining an inlet and a second side wall spaced from the first side wall, the fan housing further defining an outlet;

a baffle which is stationary coupled to the fan housing and disposed between the first and second side walls to separate the interior chamber into an impeller chamber adjacent the first side wall and a collection chamber adjacent the second side wall, the baffle including a planar baffle outer portion and a non-planar baffle inner portion defining a baffle inner edge, the baffle inner portion extending toward the first wall of the fan housing;

a hydraulic motor coupled to the second side wall of the fan housing and including:

a motor housing;

a hydraulic chamber disposed in the motor housing and fluidly communicating with the source of hydraulic fluid;

a rotatable motor shaft extending along a shaft axis, the motor shaft having a first end hydraulically coupled to the hydraulic chamber and a second end disposed in the impeller chamber, an outer surface of the motor shaft defining a shaft flow path for hydraulic fluid extending substantially parallel to the shaft axis;

a shaft seal disposed between the motor housing and the motor shaft and in the shaft flow path;

an impeller assembly coupled to second end of the motor shaft, the impeller assembly defining an impeller assembly leak flow path for hydraulic fluid extending substantially perpendicular to the shaft axis from the shaft flow path to a periphery of the impeller assembly; and a deflector disc coupled to and rotating with the impeller assembly, the deflector disc including a planar deflector disc inner portion, and a non-planar deflector disc outer portion extending toward the second wall of the fan housing and defining a deflector disc outer edge oriented toward the collection chamber and positioned axially rearward of the baffle inner edge, the deflector disc including a deflector disc rear surface defining a deflector flow path for hydraulic fluid extending from an intermediate portion of the impeller assembly leak flow path, thereby to divert leaking hydraulic fluid toward the collection chamber.

7. The fan of claim 6, in which the impeller assembly comprises an impeller plate and a plurality of impeller blades coupled to the impeller plate, each impeller blade having a radial outer periphery relative to the shaft axis, and the baffle inner edge is disposed radially inwardly of the radial outer periphery of each impeller blade.

8. The fan of claim 6, in which the impeller assembly comprises a hub, and in which the deflector disc is coupled to the hub.

9. The fan of claim 6, in which the second side wall of the fan housing defines a reservoir in a lower portion of the collection chamber.

10. A centrifugal fan for use with a source of hydraulic fluid, the fan comprising:

a baffle which is stationary including a planar baffle outer portion and a non-planar baffle inner portion defining a baffle inner edge, the baffle inner portion extending toward the first wall of the fan housing;

a hydraulic motor including a motor housing, a hydraulic chamber disposed in the motor housing and fluidly communicating with the source of hydraulic fluid, a rotatable motor shaft extending along a shaft axis, the motor shaft having an axially rearward end hydraulically coupled to the hydraulic chamber and an axially forward end disposed in the fan housing, and a shaft seal disposed between the motor housing and the motor shaft;

an impeller assembly coupled to the axially forward end of the motor shaft; and a deflector disc coupled to and rotating with the impeller assembly, the deflector disc including a planar deflector disc inner portion, and a non-planar deflector disc outer portion extending toward the second wall of the fan housing and defining a deflector disc outer edge positioned axially rearward of the baffle inner edge.

11. The fan of claim 10, in which the impeller assembly includes a hub, and in which the deflector disc is coupled to the hub.

12. The fan of claim 10, in which the impeller assembly comprises an impeller plate and a plurality of impeller blades coupled to the impeller plate, each impeller blade having a radial outer periphery relative to the shaft axis, and the deflector disc outer edge is disposed radially inwardly of the radial outer periphery of each impeller blade.

* * * * *